US008206122B2

(12) United States Patent
Rojanskiy et al.

(10) Patent No.: US 8,206,122 B2
(45) Date of Patent: Jun. 26, 2012

(54) ROTOR FOR A COMPRESSOR

(75) Inventors: Henrikh Rojanskiy, Or Akiva (IL); Avraham Ophir, Herzliya (IL)

(73) Assignee: IDE Technologies Ltd., Kadima (IL)

( * ) Notice: Subject to any disclaimer, the term of this patent is extended or adjusted under 35 U.S.C. 154(b) by 661 days.

(21) Appl. No.: 12/308,561

(22) PCT Filed: Jun. 19, 2007

(86) PCT No.: PCT/IL2007/000748

§ 371 (c)(1),
(2), (4) Date: Jun. 25, 2009

(87) PCT Pub. No.: WO2007/148338

PCT Pub. Date: Dec. 27, 2007

(65) Prior Publication Data

US 2010/0150723 A1 Jun. 17, 2010

Related U.S. Application Data

(60) Provisional application No. 60/814,583, filed on Jun. 19, 2006.

(51) Int. Cl.
*F01D 5/30* (2006.01)
*F04D 29/30* (2006.01)

(52) U.S. Cl. ..... 416/248; 416/219 R

(58) Field of Classification Search ..... 416/183, 416/185, 219 R, 248
See application file for complete search history.

(56) References Cited

U.S. PATENT DOCUMENTS

| | | | | |
|---|---|---|---|---|
| 2,989,285 | A * | 6/1961 | Warnken | 416/219 R |
| 3,749,514 | A | 7/1973 | Kelch et al. | |
| 4,008,000 | A * | 2/1977 | Gradl et al. | 416/214 A |
| 4,400,137 | A * | 8/1983 | Miller et al. | 416/220 R |
| 5,139,389 | A * | 8/1992 | Eng et al. | 416/248 |
| 5,520,008 | A | 5/1996 | Ophir et al. | |
| 6,213,719 | B1 * | 4/2001 | Violette et al. | 416/205 |
| 6,375,429 | B1 * | 4/2002 | Halila et al. | 416/193 A |
| 6,582,195 | B2 * | 6/2003 | Davidson | 416/198 A |
| 7,013,669 | B2 | 3/2006 | Ophir et al. | |

(Continued)

FOREIGN PATENT DOCUMENTS

EP 0 612 923 A1 8/1994

(Continued)

OTHER PUBLICATIONS

Tanaka et al., Rotary Machine Vane. Jan. 26, 1987 JP 62017306 abstract.*

(Continued)

*Primary Examiner* — Edward Look
*Assistant Examiner* — Liam McDowell
(74) *Attorney, Agent, or Firm* — Dvorah Graeser; Graeser Associates International Inc

(57) ABSTRACT

A rotor for mounting blades thereon to form an impeller rotatable about a main axis thereof. Each of the blades has a mounting portion. The rotor includes primary slots and auxiliary slots, each of the primary slots is adapted for receiving the mounting portion of the blade. The primary and auxiliary slots are adapted to change their dimensions during rotation of the impeller due to centrifugal forces and thermal effects caused by the rotation thereof. The change in dimensions is adapted to exert pressure on the mounting portion of the blade to retain it within the primary slot.

19 Claims, 7 Drawing Sheets

U.S. PATENT DOCUMENTS

| | | | | |
|---|---|---|---|---|
| 7,481,625 | B2 * | 1/2009 | Kim | 416/185 |
| 2004/0052641 | A1 | 3/2004 | Chen | |

FOREIGN PATENT DOCUMENTS

| | | | |
|---|---|---|---|
| FR | 1 375 168 | A | 10/1964 |
| GB | 761872 | * | 11/1956 |
| JP | 62017306 | * | 1/1987 |

OTHER PUBLICATIONS

Leyzerovich, Alexander, Large Power Steam Turbines: Design and Operation, 1997, pp. 270-286, vol. 1, PennWell Publishing Company, Tulsa, Oklahoma, United States of America.

* cited by examiner

ROTOR FOR A COMPRESSOR

CROSS-REFERENCE

This is a National Phase Application filed under 35 U.S.C. 371 as a national stage of PCT/IL2007/000748, with the filing date of Jun. 19, 2007, an application claiming the benefit under 35 USC 119(e) U.S. Provisional Patent Application No. 60/814,583, filed on Jun. 19, 2006, the entire content of which is hereby incorporated by reference in its entirety.

FIELD OF THE INVENTION

This invention relates to rotors, more particularly to rotors for compressors working in vacuum conditions.

BACKGROUND OF THE INVENTION

Examples of Vacuum compressors and rotors used therein, of the kind to which the present invention refers, are disclosed in U.S. Pat. No. 5,520,008 and U.S. Pat. No. 7,013,669 to the Applicant.

SUMMARY OF THE INVENTION

According to the present invention there is provided an axi-symetric rotor adapted for engagement with blades and a bearing shaft, to be used as a part of a compressor assembly working in vacuum conditions, said rotor being adapted for rotation by said shaft.

According to one aspect of the present invention the rotor is adapted for mounting of a plurality of blades thereon to form an impeller rotatable about a main axis thereof, each of said plurality of blades having a mounting portion, said rotor comprising primary slots and auxiliary slots, wherein each of said primary slots is adapted for receiving the mounting portion of one of said blades, and said primary and auxiliary slots are adapted to change their dimensions during rotation of said impeller due to centrifugal forces and thermal effects resulting from said rotation and thereby exert pressure on said mounting portion when inserted in said primary slot to retain said blade within said primary slot.

The rotor may further comprise top and bottom inserts adapted to receive therein extensions of the mounting portion of said blade for better retention of the blade within said primary slot. The rotor may also be adapted for the mounting of a hub thereon which may have a hyperbolic form adapted to facilitate better flow about impeller during said rotation. In this regard, the hub may be so mounted as to facilitate retention of the blades within said primary slots when mounted onto the rotor.

The auxiliary slots may be disposed on each side of said primary slot and spaced therefrom, such that each primary slot is associated with a left auxiliary slot (las) and a right auxiliary slot (ras). Each of said auxiliary slots may have an extension 'L' from the perimeter of said rotor towards said main axis, which is greater than an extension 'l' of the associated primary slot from the perimeter of said rotor towards the main axis ('L'>'l') and may be of smaller width than said primary slot.

The number of said auxiliary slots may vary according to the concentration of primary slots per section of the rotor, as well as the dimension of said primary slots. Thus, for example, for an arrangement of primary slots which are sparsely disposed about the main axis, two auxiliary slots may be formed between each two adjacent primary slots, such that one auxiliary slot may serve a as a ras for one primary slot, and the other auxiliary slot may serve as a las for the other primary slot. When the rotor is densely populated with said primary slots, a single auxiliary slot may be formed between each two adjacent primary slots, wherein the same auxiliary slot serves both as a las for one primary slot and a ras for the other primary slot.

The blades of said impeller may be made of a composite material allowing the shaping of the blade in a variety of shapes including three-dimensional curved shapes. The curved shape of said blades may be so designed that when inserted into the primary slots of said rotor, the blades form three dimensional diffusion channels between each two adjacent blades, removing the need for connecting elements, such as for example, diaphragms, to form said diffusion channels. In addition, the mounting portion of the blade may comprise extensions adapted to be received within said rotor for further securing of the blade within said primary slots. The extensions may be of various forms, for example, rectangular.

In operation, during rotation of said impeller, the rotor body undergoes an increase in dimensions as a result of centrifugal forces and thermal effects. During this increase in dimensions, the width of said primary and auxiliary slots is forced to increase. However, due to the greater extension of said auxiliary slots towards the main axis in comparison with said primary slots, the width of said auxiliary slots increases on the expense of the increase of said primary slot, in fact causing a decrease in the width of said primary slot, thereby exerting pressure on the mounting portion of said blade inserted therein.

According to another aspect of the present invention, there is provided a mounting arrangement for fixedly mounting thereon a rotor having a central axis and a mounting bore, said arrangement comprising an axle formed with a through-going central bore and a conical nose, a clamping bolt and a bearing shaft formed with a receiving conical bore and a threaded mounting hole, said conical nose being adapted to fit into said receiving conical bore, said axle being adapted to receive said clamping bolt within its central hole to be threaded into the mounting hole of said bearing shaft, whereby said conical nose is fixedly clamped to said bearing shaft, and whereby said rotor may be mounted on the bearing shaft even after blades have been installed thereon to form an impeller.

The rotor may be mounted onto the axle with an interference fit in order to provide matching of the rotor with said axle even during high speed rotation in all range of the working temperatures. Such interference fit may be achieved by heating and cooling of the rotor body and may eventually prevent the loosening of the rotor's grip over the axle during thermal expansion of the rotor as a result of rotation of the impeller.

According to yet another aspect of the present invention there is provided an impeller comprising a rotor according to the previous aspect of the present invention and a plurality of blades, which may be held in said primary slots by any appropriate additional means such as, for example, an adhesive.

It should be noted that the primary purpose of adhesive material maintained above, is to retain the blades within the impeller when the impeller is at rest, i.e. not rotating, rather than to retain the blade within the primary slot during rotation of said impeller, i.e. replacing the common bolt gripping arrangement.

According to a further aspect of the present invention there is provided a mounting arrangement for fixedly mounting thereon the above impeller, said arrangement comprising an axle formed with a through-going central bore and a conical nose, and a bearing shaft formed with a receiving conical bore and a threaded mounting hole, said conical nose being adapted to fit into said receiving conical bore, said axle further being adapted to receive a clamping bolt through its central hole to be threaded into the mounting hole of said bearing shaft, whereby the nose is fixedly clamped to the bearing shaft, and whereby the impeller may be mounted on the bearing shaft.

According to still another aspect of the present invention there is provided a compressor adapted to work in conjunction with the impeller described above, said compressor comprising said impeller, said mounting arrangement, and a driving motor.

BRIEF DESCRIPTION OF THE DRAWINGS

In order to understand the invention and to see how it may be carried out in practice, embodiments will now be described, by way of a non-limiting example only, with reference to the accompanying drawings, in which.

DETAILED DESCRIPTION OF EXEMPLARY EMBODIMENTS

With reference to FIGS. 1A to 1F, an impeller, generally designated 10, is shown comprising a rotor 20 with a main axis X-X and a plurality of blades 30 mounted to the rotor.

Figure 1A:
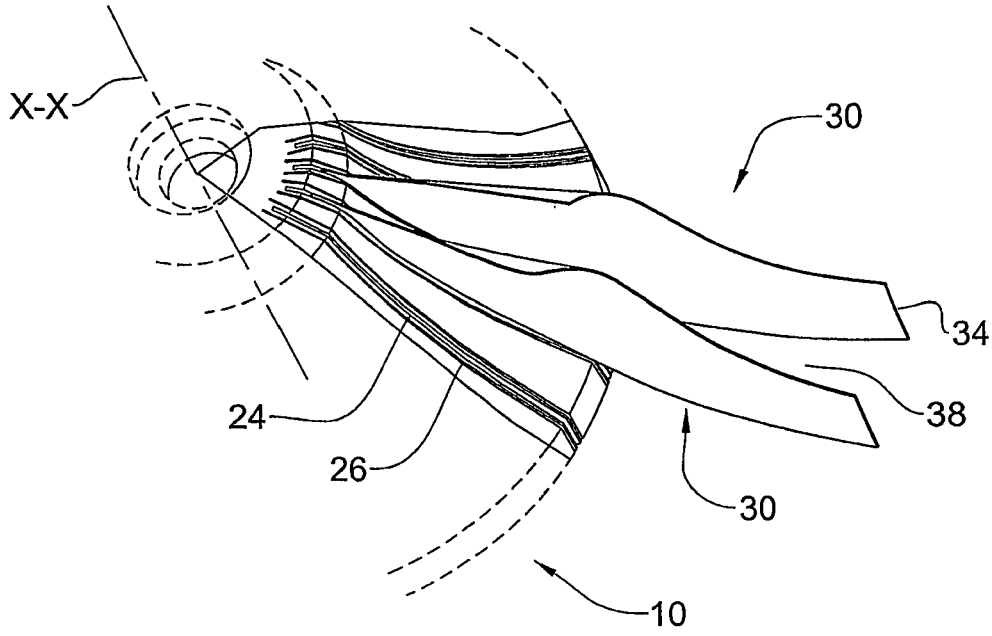
FIG. 1A is an isometric view of a section of an impeller according to one example of the present invention, with two blades inserted therein.
Figure 1B:
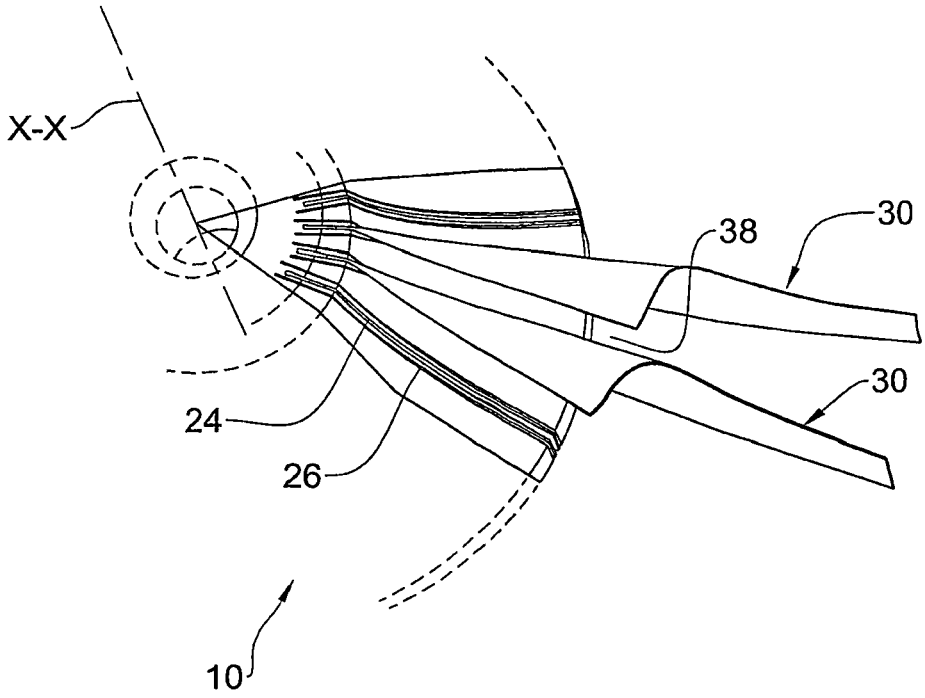
FIG. 1B is another isometric view of the impeller shown in FIG. 1A.
Figure 1D:
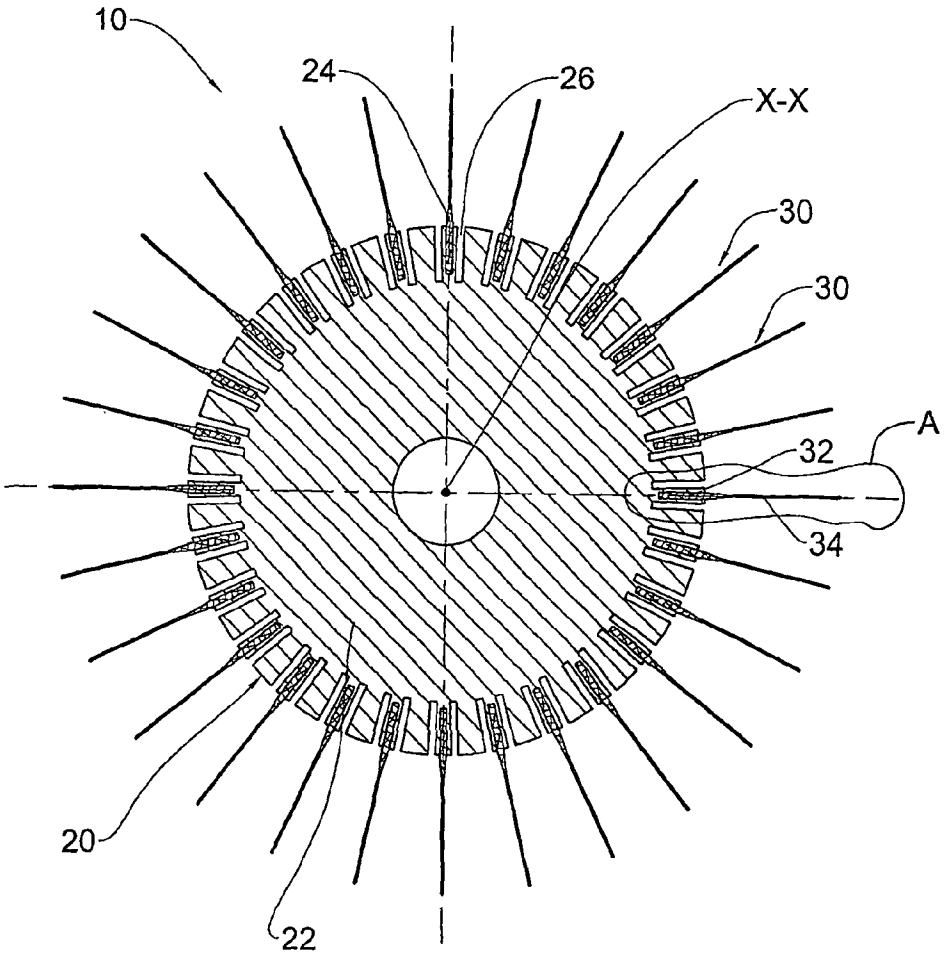
FIG. 1D is a cross-sectional view of the impeller shown in FIG. 1A, taken perpendicular to the main axis.
Figure 2A:
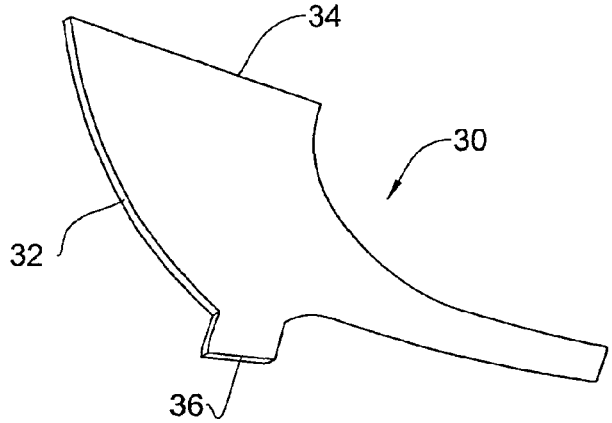
FIG. 2A is an isometric front view of a blade used in the impeller shown in FIG. 1A.
Figure 2B:
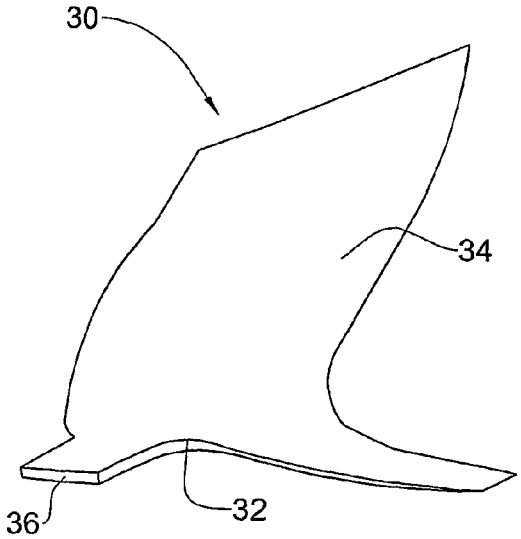
FIG. 2B is an isometric bottom view of a blade shown in FIG. 2A.

Turning to FIGS. 2A and 2B, the blade 30 is shown to have a mounting portion 32 and an impelling portion 34. The blade 30 is adapted to be mounted into the rotor 20 and to be held therein at the mounting portion 32 thereof. The mounting portion 32 further comprises a rectangular extension 36 adapted for further gripping of the mounting portion 32 by the rotor 20. The blade 30 is made of composite material, which allows the impelling portion 34 of the blade to receive a curved shape and at the same time remain substantially light and durable. The curved shape of the blade 30 is such that each two adjacent blades 30 form a three dimensional diffusion channel therebetween (as can be seen in FIGS. 1A and 1B). The formation of the diffusion channels removes the need for connectors between the blades, e.g. a connecting diaphragm, as disclosed in the Background of the Invention.

Figure 3:
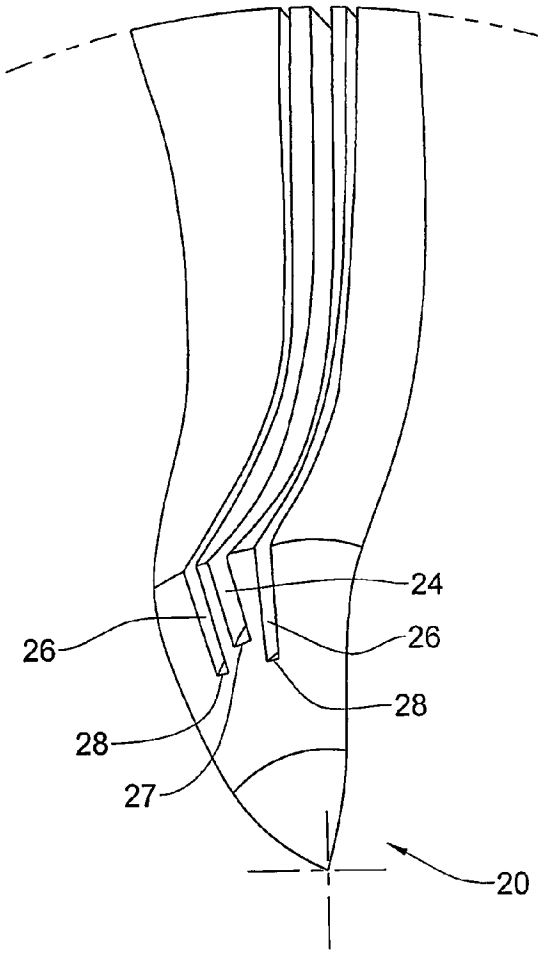
FIG. 3 is an isometric view of a portion of the rotor of the impeller of shown in FIG. 1A.

Reverting to FIGS. 1A and 1B and with reference to FIG. 3, the rotor 20 has a hyperboloid shaped body 22 formed with a set of primary slots 24 equally spaced around the axis X-X, and a set of auxiliary slots 26 formed on each side of every primary slot 24 and spaced therefrom. Each primary slot 24 is adapted to receive the mounting portion 32 of a compressor blade 30 (shown FIGS. 2A and 2B). The auxiliary slots 26 are formed slightly narrower and deeper than the primary slots 24 for purposes that will be explained in detail later.

Figure 1C:
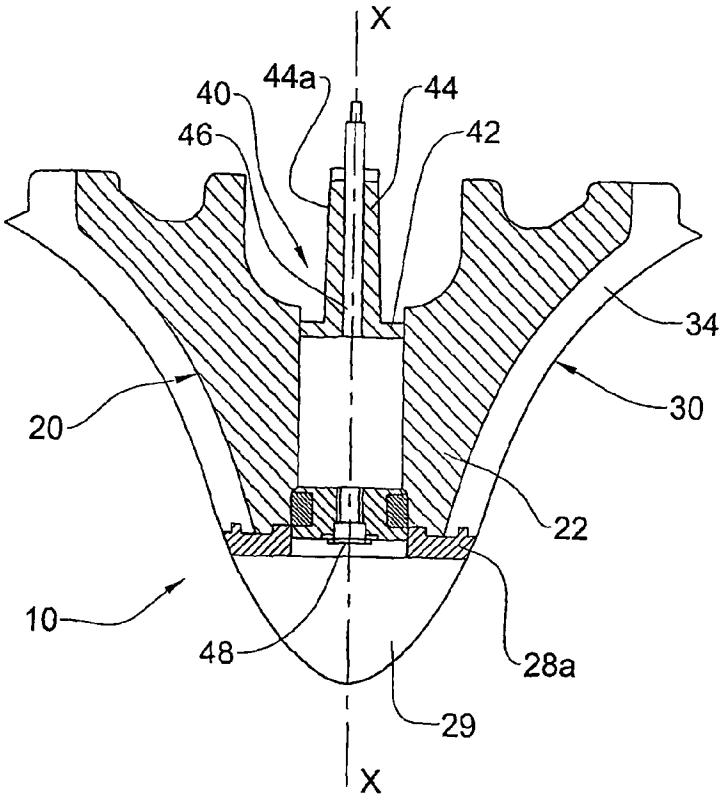
FIG. 1C is a cross-sectional view taken along the main axis of the impeller shown in FIGS. 1A and 1B.
Figure 1E:
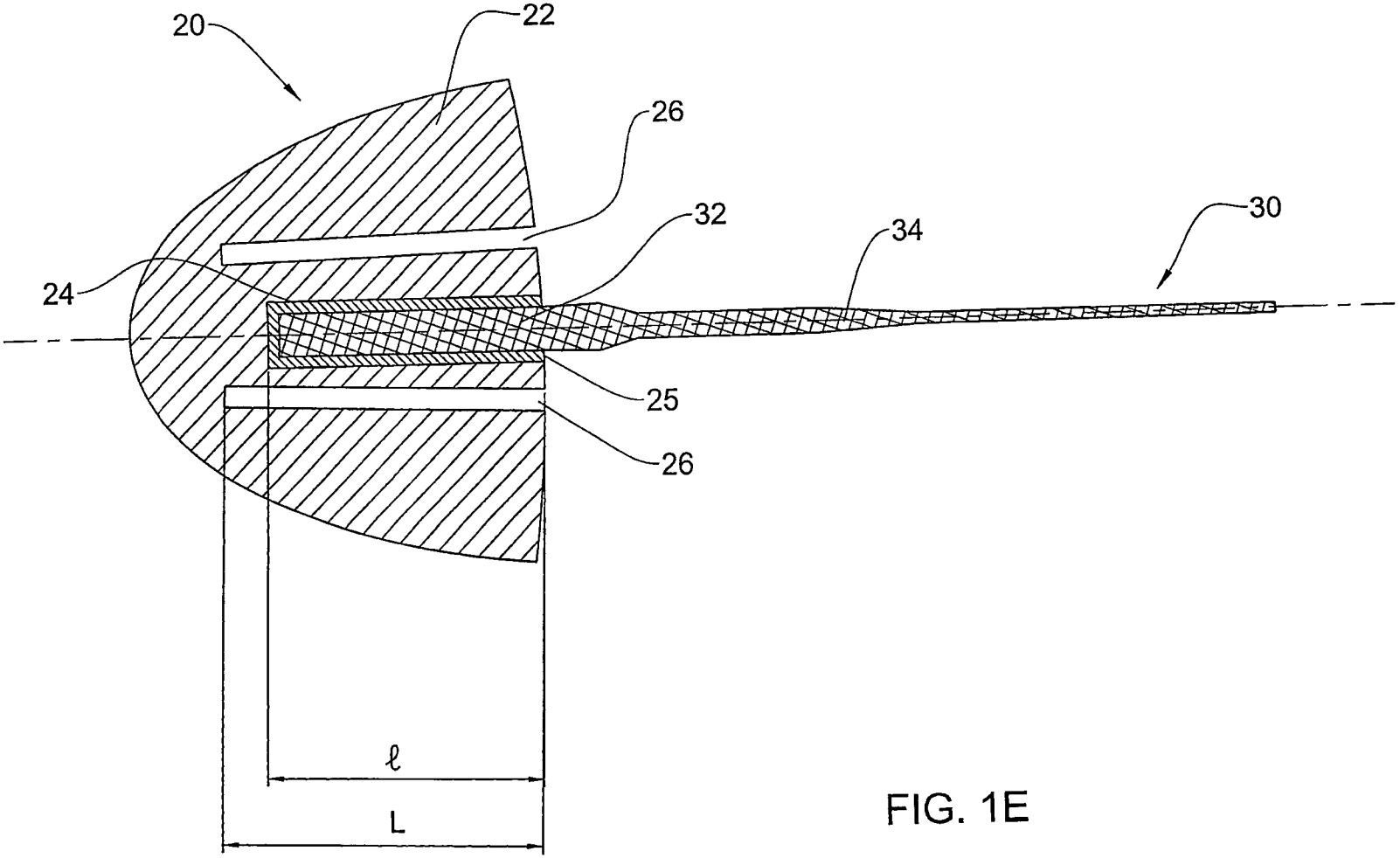
FIG. 1E is an enlarged view of detail 'A' of the impeller shown in FIG. 1C.
Figure 1F:
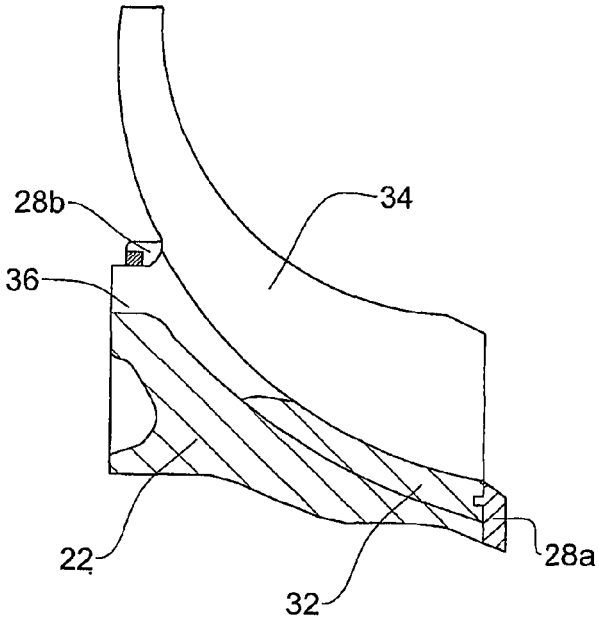
FIG. 1F is an enlarged view of a portion of the impeller shown in FIG. 1C.

With further reference also to FIG. 1C the blades 30 are mounted into the primary slots 24 to form the impeller 10, and may be held in place using an adhesive (shown FIG. 1E). In order to provide further means of security for mounting of the blades 30 onto the body 22 of the rotor 20, the mounting portion 32 of the blades 30 is held within the primary slot 24 from the top and bottom by connectors 28*a* and 28*b* respectively (seen also FIGS. 5 and 6). The bottom connector 28*b* is adapted for gripping the rectangular extension 36 of the blade 30. The impeller 10 further comprises a hyperboloid shaped hub 29 mounted onto the rotor body 22. The hub 29 is also adapted to apply pressure to the top connector 28*a* in order to secure the blades 30 within the primary slots 24.

Turning now to FIG. 1E, the compressor blade 30 is shown mounted into the primary slot 24 of the rotor body 22. The primary slots have a radial extension 'l' towards the main axis X-X. Auxiliary slots 26, are formed on each side of every primary slot 24, and have a radial extension 'L', towards the main axis X-X, such that 'L'>'l'. The adhesive material 25 is inserted into the primary slot 24 such that it surrounds the mounting portion 32 of the blade 30, thereby facilitating the holding the blade 30 in place. It should be noted that the purpose of the adhesive material 25 is mainly to hold the blade in place when the impeller 10 is at rest, i.e. not rotating, and that the effect of the adhesive material 25 is less significant when the impeller 10 is rotating.

Figure 4:
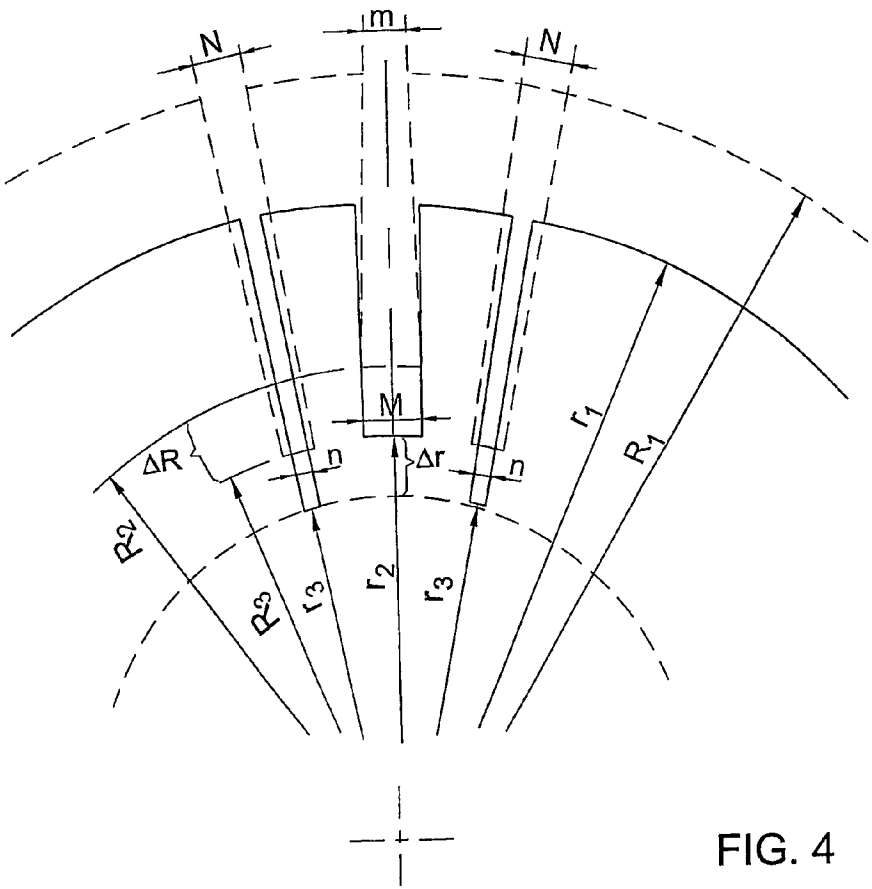
FIG. 4 is a schematic view of a part of the rotor in rest and in operation of the impeller shown in FIG. 1A.

Turning to FIG. 4, When in rest, the radius of the outer circumference of the body 22 is '$r_1$', and the roots 27 and 28 of the primary and auxiliary slots 24 and 26 respectively, are located at a circumference of '$r_2$' and '$r_3$' respectively, corresponding to 'l' and 'L' of FIG. 1E. The difference between '$r_2$' and '$r_3$' is marked 'Δr'. The widths of the primary slots 24 and the auxiliary slots 26 are designated 'M' and 'n' respectively.

In operation, during rotation of the impeller 10, there occurs an increase in the dimensions of the rotor body 22 (dashed lines) due to its expansion caused by centrifugal forces and thermal effects, thus becoming of a radius '$R_1$'>'$r_1$'. This increase in the dimension of the body 22, also causes an increase in the dimension of the circumference of the roots 27 and 28 of the slots 24 and 26 respectively, such that they are now positioned at radiuses '$R_2$' and '$R_3$' respectively, such that '$R_2$'>'$r_2$' and '$R_3$'>'$r_3$'. The auxiliary slots 26 are thus stretched, changing their width to a width of 'N', such that 'N'>'n'. Since the auxiliary slots 26 are formed on either side of the primary slot 24, the increase in width from 'n' to 'N', subsequently yields a decrease in the width 'M' of the primary slot 24, due to pressure exerted on both sides of the primary slot 24, thereby becoming of width 'm', such that 'm'<'M'. This shrinkage of the width of the primary slot 24 along with the previously mentioned adhesive 25 keeps the blade 30 fixed to the rotor 20. It should be noted, that during the expansion, the distance 'Δr' remains substantially the same, i.e. '$\Delta r_{2\text{-}3}$'≅'$\Delta R_{2\text{-}3}$', due to specific relations between the width of the primary and auxiliary slots 24 and 26, and the distance between them.

When the impeller is at rest, the blades 30 are held in place only by the adhesive 25. In contrast to impellers known in the art, when the impeller according to the present invention is in motion, the decrease in width from 'M' to 'm' presses on the mounting portion 32 of the blade 30 and fixes it in place. In common rotors, since there are no auxiliary slots, the width 'M' of the primary slot would increase during rotation, and causes loosening of the grip on the blade. Avoiding this usually requires an elaborate mounting arrangement containing tangent bolts designed to hold the slot at a constant width in order to prevent ejection of the blade from the rotor. The present invention elegantly eludes this problem, not only removing the need of an elaborate mounting arrangement but also highly simplifying the preparation of the body 22.

In this particular example, two auxiliary slots 26 are formed between each two primary slots 24. However, it should be appreciated that the arrangement of slots as shown in the previous figures may vary, e.g. only one auxiliary slot 26 between two adjacent blades 30 may be formed. For example, if the distance between two adjacent blades is too small, creation of two slots may result in too small a distance, i.e. several cm, between two primary slots, requiring the use of only one auxiliary slot, serving two the primary slots on either side. On the other hand, if the distance between two blades is too big, the distance between primary slots may be too big, i.e. tens of cm, requiring the use of two auxiliary slots.

Reverting back to FIG. 1C, the impeller 10 further comprises a mounting arrangement 40 positioned within the rotor 20 along axis X-X, adapted to facilitate mounting of the impeller 10, i.e. rotor 20 and blades 30 mounted thereon, onto a bearing shaft 50 to form a compressor assembly 100. The mounting arrangement comprises a central axle 42 formed with a conical nose 44 coaxial with the rotor body 22 projecting from one side, i.e. top side. The nose 44 has an outer surface 44*a*. A through-going central bore 46 extends along the entire length of the axle 42 in the direction of the axis X-X, and is adapted to receive a clamping bolt 48 therein. The bolt is sufficiently long so as to project from the conical nose 44.

Figure 5:
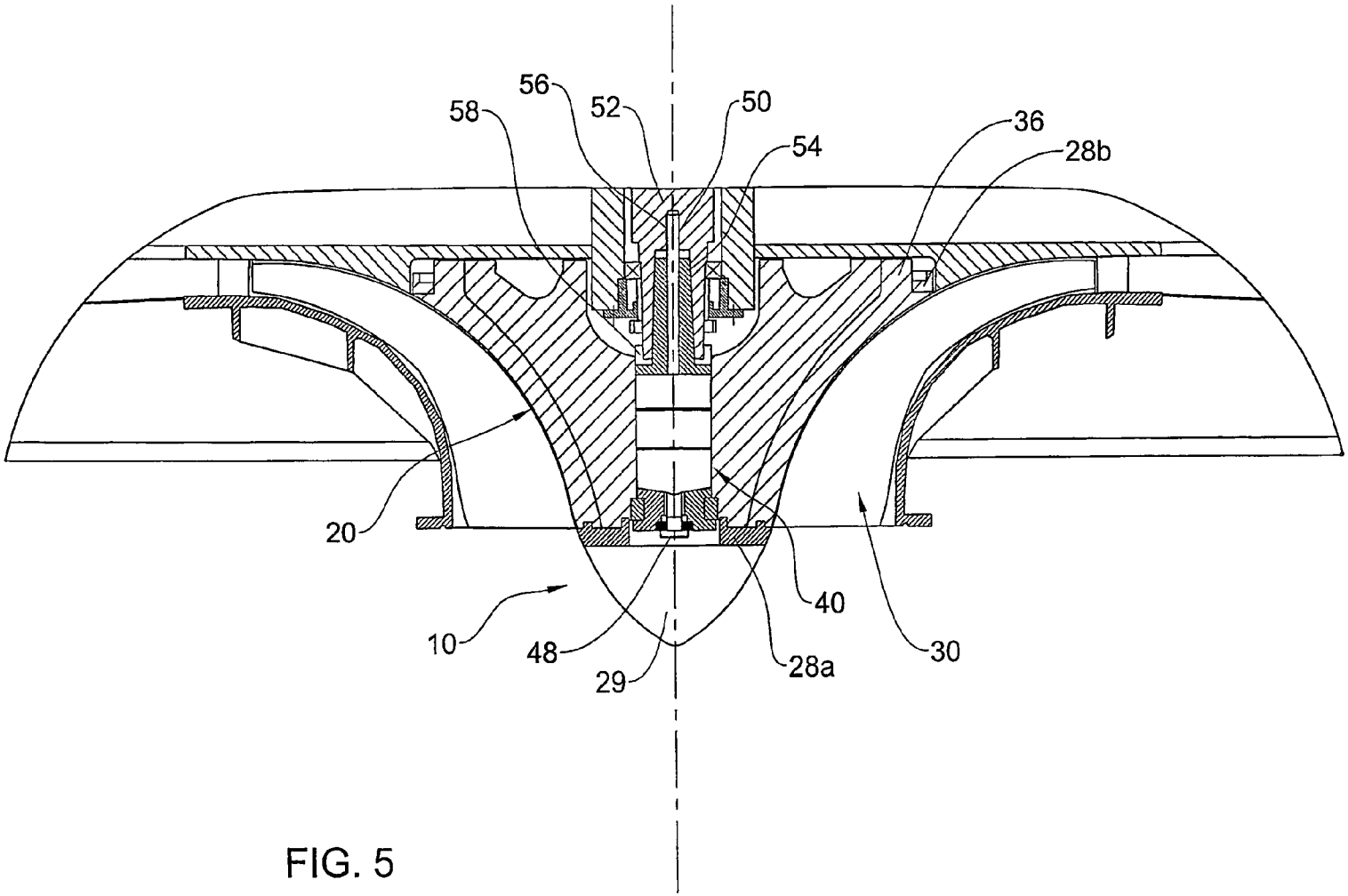
FIG. 5 is a schematic view of a part of a compressor assembly in which the impeller shown in FIG. 1 is installed.

Referring now to FIG. 5, the impeller 10 with the blades is shown mounted onto the bearing shaft 50. The conical nose 44 is positioned within a corresponding receiving conical bore 54 formed in the bearing shaft 52. The inner part of the conical bore 54 is further formed with a threaded hole 56, adapted to receive the clamping bolt 48. The bearing shaft 50 is further formed with two teeth 58 for transferring rotation to the impeller 10 and axle 42.

In assembly, the impeller 10 is mounted onto the axle 42 with an interference fit. The interference fit provides the matching of the rotor body 22 with axle 42 even during high speed rotation in the entire range of working temperatures. The blades 30 are then mounted onto the rotor 20 and the rotor with the blades and the mounting arrangement 40 are mounted on the bearing shaft 50, such that the conical nose 44 is inserted into the conical hole 54. The clamping bolt 48 is then tightened until the impeller 10 is fixed to the bearing shaft 50, i.e. the outside surface of the conical nose 44 is flush against the inside surface of the conical hole 54. The rotor's hemisphere 29 is then placed and the impeller 10 is ready for operation. In other words, as described above, the mounting arrangement 40 according to the present invention allows mounting of the impeller 10 onto the bearing shaft 50 when the blades 30 are already mounted onto the rotor 20.

Figure 6:
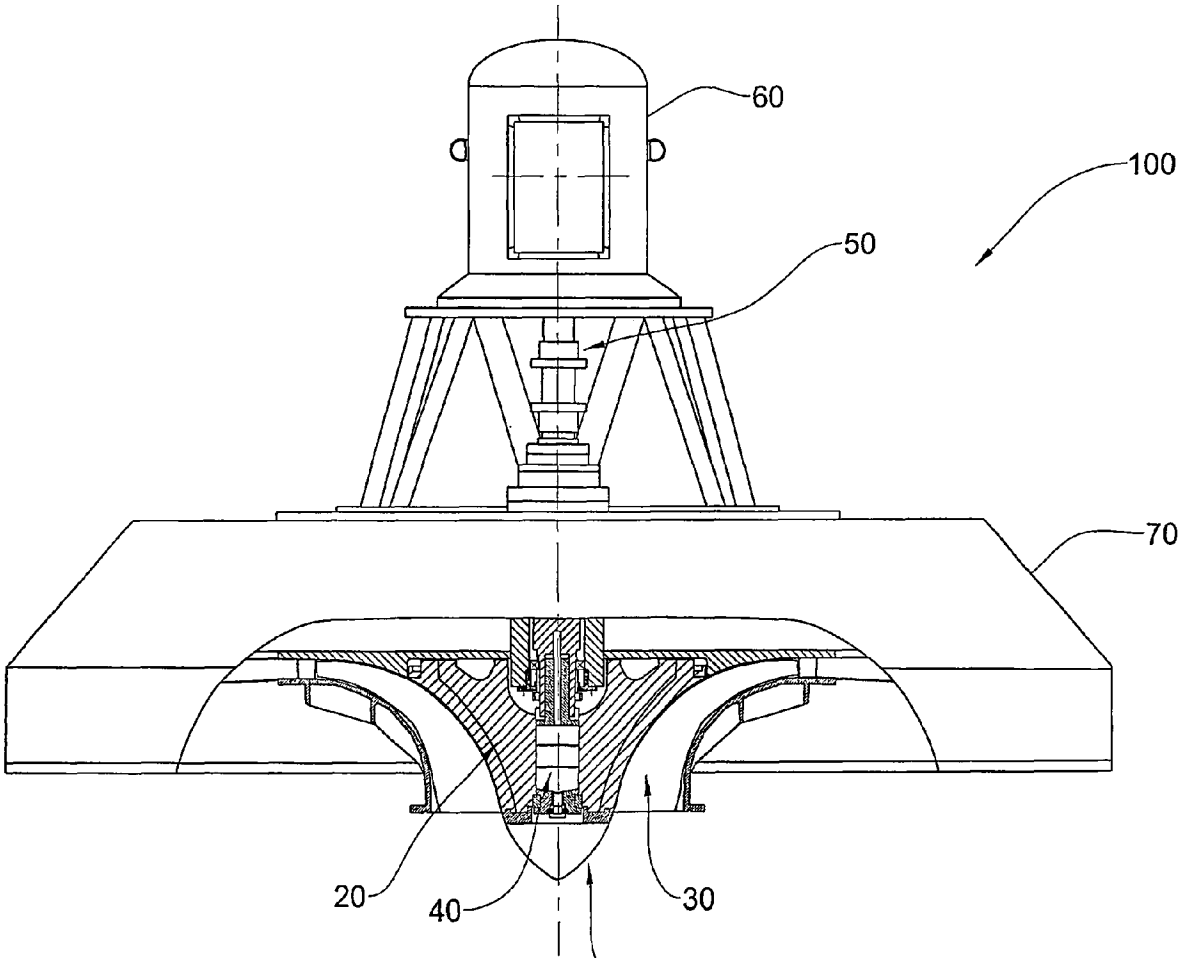
FIG. 6 is a schematic partially sectioned view of a compressor comprising the impeller shown in FIG. 1.

FIG. 6 illustrates a complete compressor assembly, generally designated 100, comprising the impeller 10, mounted on the bearing shaft 50 and connected to the motor 60. The cover 70 may be a part of a tank forming, for example, a heat pump in which the compressor is used in this particular example.

The invention claimed is:

1. A rotor adapted for mounting of a plurality of blades thereon to form an impeller rotatable about a main axis thereof, each of the plurality of blades having a mounting portion, the rotor comprising primary slots and auxiliary slots that are radially deeper than the primary slots, wherein:

each of the primary slots is adapted for receiving the mounting portion of one of blades, the primary and auxiliary slots are adapted to change their dimensions during rotation of the impeller due to centrifugal forces and thermal effects resulting from the rotation, wherein the deeper auxiliary slots change their dimensions to decrease a width of the primary slots and thereby exert pressure on the mounting portion inserted in the primary slot to retain the blade held within the primary slot.

2. The rotor according to claim 1, wherein the rotor further comprises top and bottom inserts adapted to receive therein extensions of the mounting portion of the blade for retention of the blade within the primary slot.

3. The rotor according to claim 1, wherein the rotor is adapted for the mounting of a hub thereon being so mounted as to facilitate further retention of the blades within the primary slots when mounted onto the rotor.

4. The rotor according to claim 3, wherein the hub is of a hyperbolic form adapted to facilitate better air flow about the impeller during the rotation.

5. The rotor according to claim 1, wherein the primary slot further contains an adhesive material introduced therein to retain the blade attached to the impeller.

6. The rotor according to claim 1, wherein each of the primary slots has an extension of length 'l' from a perimeter of the rotor towards the main axis, and each of the auxiliary slots has an extension of length 'L' from the perimeter of the rotor towards the main axis, such that 'L'>'l'.

7. The rotor according to claim 1, wherein the auxiliary slots are disposed on each side of the primary slot and spaced therefrom.

8. The rotor according to claim 1, wherein each of the auxiliary slots has a width which is smaller than that of the primary slot.

9. The rotor according to claim 1, wherein two auxiliary slots are disposed between each two adjacent primary slots, such that one auxiliary slot serves as a right auxiliary slot for one of the primary slots, and the other auxiliary slot serves as a left auxiliary slot for the other primary slot.

10. The rotor according to claim 1, wherein a single auxiliary slot is disposed between each two adjacent primary slots, the auxiliary slot serving both as a left auxiliary slot for one primary slot and a right auxiliary slot for the other primary slot.

11. The rotor according to claim 1, wherein the blades are made of a composite material.

12. The rotor according to claim 11, wherein the blades are of a curved three dimensional shape.

13. The rotor according to claim 12, wherein the curved shape is such that when inserted into the primary slots of the rotor, a three dimensional diffusion channel is formed between each two adjacent blades.

14. The rotor according to claim 2, wherein the mounting portion of the blade further comprises extensions adapted to be received within the inserts of the rotor for further securing of the blade within primary slots.

15. The rotor according to claim 14, wherein the extensions are of rectangular shape.

16. The rotor according to claim 1, wherein during rotation of the impeller the width of the auxiliary slots increases to cause a decrease in the width of the primary slots, thereby exerting pressure on the mounting portion of the blade inserted therein.

17. The mounting arrangement according to claim 1, wherein the rotor is mounted onto the axle with an interference fit.

18. The mounting arrangement according to claim 17, wherein the interference fit is achieved by heating and cooling of the rotor body.

19. A compressor comprising:

an impeller rotatable about a main axis, comprising:

a plurality of blades, each having a mounting portion, and a rotor having a central axis and a mounting bore, and adapted for mounting of the blades, and comprising primary slots and auxiliary slots that are radially deeper than the primary slots, wherein:

each of the primary slots is adapted for receiving the mounting portion of one of the blades, the primary and auxiliary slots are adapted to change their dimensions during rotation of the impeller due to centrifugal forces and thermal effects resulting from the rotation, wherein the deeper auxiliary slots change their dimensions to decrease a width of the primary slots and exert pressure on the mounting portion inserted in the primary slot to retain the blade held within the primary slot, and mounting arrangement for fixedly mounting the rotor thereon, the arrangement comprising:

an axle formed with a through-going central bore and a conical nose, a clamping bolt, and a bearing shaft formed with a receiving conical bore and a threaded mounting hole, wherein:

the conical nose is adapted to fit into the receiving conical bore, the axle is adapted to receive the clamping bolt within its central hole to be threaded into the mounting hole of the bearing shaft, the conical nose is fixedly clamped to the beating shaft, and the rotor is mountable on the bearing shaft after blades have been installed thereon to form the impeller, and a driving motor.

* * * * *